US008574006B2

(12) United States Patent
Gilliam

(10) Patent No.: US 8,574,006 B2
(45) **Date of Patent: *Nov. 5, 2013**

(54) SHIELDED MULTI-POLE ELECTRICAL CONNECTOR

(76) Inventor: Charles David Gilliam, Baton Rouge, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/447,749

(22) Filed: Apr. 16, 2012

(65) Prior Publication Data

US 2013/0171871 A1 Jul. 4, 2013

Related U.S. Application Data

(63) Continuation-in-part of application No. 12/723,024, filed on May 20, 2010, now Pat. No. 8,157,594.

(51) Int. Cl.
*H01R 13/648* (2006.01)

(52) U.S. Cl.
USPC ..... 439/607.41; 439/578; 439/583

(58) Field of Classification Search
USPC ..... 439/607.41, 578, 583
See application file for complete search history.

(56) References Cited

U.S. PATENT DOCUMENTS

| | | | | |
|---|---|---|---|---|
| 3,783,434 | A * | 1/1974 | Ransford, III | 439/281 |
| 5,174,769 | A * | 12/1992 | Dearman | 439/98 |
| 5,269,701 | A * | 12/1993 | Leibfried, Jr. | 439/578 |
| 6,692,299 | B1 * | 2/2004 | Stockmaster | 439/578 |
| 7,335,059 | B2 * | 2/2008 | Vaccaro | 439/578 |
| 7,442,096 | B1 * | 10/2008 | Gilliam | 439/825 |
| 7,465,190 | B2 * | 12/2008 | Henningsen | 439/578 |
| 7,566,243 | B1 * | 7/2009 | Hung | 439/578 |

* cited by examiner

*Primary Examiner* — Gary Paumen
(74) *Attorney, Agent, or Firm* — Roy Kiesel Ford Doody and Thurmon

(57) ABSTRACT

A high-power, shielded, multi-pole electrical connector and method for installing such a connector are disclosed. The connector has separate structure for connecting each line of a multi-pole connector, with this structure housed within an electrically conductive outer shell. The inner connections are electrically insulated and shielded from the outer shell. A shielding trap is used to provide electrical contact between the outer shell of the connector and a shielding layer of a shielded electrical supply cable. The inner structure may be a male-female type or a lug-type connection. In a typical arrangement, a three-pole connector is used to provided a shielded connection to each of three power lines within a shielded cable.

17 Claims, 8 Drawing Sheets

SHIELDED MULTI-POLE ELECTRICAL CONNECTOR

CROSS-REFERENCES

This is a continuation-in-part application claiming priority based on application Ser. No. 12/723,024.

FIELD OF THE INVENTION

The invention relates to a shielded, multi-pole electrical connector for use in high-power applications. The invention is particularly suited for use with high-power variable frequency AC drive motors.

BACKGROUND OF THE INVENTION

AC motors spin at a speed determined by the number of poles and the frequency of the applied AC current. The speed in revolutions per minute (RPM) is equal to 120× frequency (Hz) divided by the number of poles. For example, a motor with four poles operating at 60 Hz, would have a nominal speed of 1800 rpm. The operating speed of traditional AC motors is relatively constant, though in practice, the loaded speed does vary.

The rotational speed of DC motors, on the other hand, varies with supply voltage. By reversing the polarity of the supply voltage, a DC motor will reverse direction. Speed control, therefore, is a fairly simple matter with DC motors. When speed control is important, and the ability to reverse the direction of rotation is also needed, DC motors provide one effective option.

The oil industry is one area where high-power rotational motors with reliable speed control are used. An oil well is drilled by rotating a drill string with a drill bit at its end. Today, it is common for a variety of exploration tools to be mounting in the drill string, typically near the drill bit. These tools measure temperature, pressure, density of the formation, resistivity or conductivity of the formation, and various other parameters of interest to oilfield exploration engineers.

In an oilfield drilling operation, it is desirable to control the speed of the drill motor. This can be important for optimum effectiveness of the drilling bit, for removal of cuttings, and for the operation of tools installed in the drill string. Large DC motors traditionally have been used in the oilfield for this purpose. These motors are not very efficient, but they do provide reasonably good control of the rotational speed of the drill string. These motors also provide high torque, which is crucial in this industrial setting.

Variable frequency drive (VFD) AC motors have become increasingly popular in recent years, including in the oilfield industry. VFD motors are a good alternative to DC motors, in large part because the VFD motors are more efficient. Improvements in the technology in recent years have made large VFD motors a reliable, efficient option in many heavy industries. The oilfield industry has been opting for large VFD motors more and more in recent years.

To supply VFD motors, two conversions are done. First, the AC supply is converted to DC, and then the DC is converted to a variable frequency AC signal. In the most common arrangement, the variable frequency AC signal is made up of a series of DC pulses. Pulse width modulation of a DC output is used to create a simulated AC sine wave signal. The DC polarity is reversed to create the negative portion of the simulated sine wave.

This process involves a great deal of high speed switching. In high-power applications, the switching components may have to switch on and off thousands of times per second, and may rise and fall by hundreds of volts with each switch. This type of switching produces a great deal of harmonic and switching noise in the system. These noise components of the total signal will be carried by the conductors from the power supply to the motors.

The VFD noise can cause problems with electronic systems operated in the same physical area. Computer equipment can experience problems. Control and monitoring equipment also may experience problems due to the VFD noise. VFD motors offer important benefits, but the problems caused by the VFD noise must be controlled, or this problem may outweigh the benefits of a VFD system.

To limit the transmission of the noise signals, shielded power cables are typically used in applications where VFD noise poses a problem. Again, the oilfield industry provides a good example. During the oil drilling operation, computers and other electronic equipment are used to monitor and evaluate various parameters. VFD noise can cause serious problems in the oil drilling situation if it is not controlled. Shielded power cables are often used for this reason in oilfield applications where VFD motors are used.

A typical shielded cable application in the oilfield might involve use of single, shielded power cables running from the VFD power supply to the VFD motor. The cables are hard-wired at each end, so no separate inline connectors are used. The shielding is grounded at one or both ends of the run. The internal, shielded, power conductor supplies the VFD current to the VFD motor. The continuous run of shielding on the power cable contains most of the potentially harmful VFD noise.

This typical arrangement will not work, however, if a connection is needed somewhere between the supply and the drive motor, or at either end of the power cable. For example, if the run from the VFD power supply to the VFD motor is too long for a single cable, it is necessary to use some type of inline connector to piece together the different sections of shielded cable. This may be a fairly common situation because the shielded cable used in oilfield and other heavy industries tends to be quite large and heavy. Such cable may weigh several pounds per foot, making long cable runs quite heavy and unwieldy. Using shorter sections of cable connected together with separate connectors is one way of addressing this problem.

Cable connections also may be needed at the VFD motor or at the supply. Use of a connector at these points allows for easier replacement of a cable, when compared to a hard-wired arrangement. In oilfield drilling operations, the drive motor may be moved up and down during the drilling process. The drive motor may also need to be moved to another position for service or inspection. With so much movement, the connections between the cable and the drive motor will be subject to stress and may fail after extended use. In addition, if the drive motor is to be moved for inspection or service, there may be a need to disconnect the drive motor from its supply cables. These connection and disconnection operations are much easier to accomplish if a separate connector is used, as opposed to hard-wiring the supply cables to the drive motor.

If a nonshielded connector is used, some of the noise found in the VFD power lines will be transmitted to various items that may be damaged by such noise. Computers and other electronic equipment may be vulnerable to such damage. It is, therefore, highly desirable to ensure than the entire electrical path from the VFD power supply to the VFD motor, including all connections, is fully shielded. Shielded high-power cables are relatively easy to find, but there remains a need for high-power shielded connectors.

The need for an inline or end-of-cable connector in high-power VFD applications poses a problem. Low power shielded cable connectors are well known. Such connectors are used widely on home cable television and Internet systems. The small, shielded connectors used in such applications provide a continuous shield for any noise that exists on the cable signal.

In a typical low power shielded connector, the cable has a small internal core conductor that carries the signal of interest. An insulator surrounds the core conductor, and a braided shield surrounds the core insulator. Another insulator, typically the outer covering of the cable, is positioned over the braided shield wires. The shielded connector connects the braided shield wires to the outer shell of the connector and connects the core conductors while providing an insulation layer between the core conductors and the shell of the connector. In this manner, a continuous electrical path is provided for both the core conductor and the braided shield, with these two paths being electrically insulated from each other.

The same concept is possible, and needed, in the high-power VFD motor context. It is, however, a huge step to go from the small, shielded connectors used with home cable television systems to the sort of shielded connector needed for a high-power VFD situation. The core conductor in a home television cable is not much larger than a piece of thread or fishing line. The cable is light, the shielding is very thin and easily handled. The current capacity of these systems, and the connectors used with these systems, is quite low. These low-power connectors rarely see currents in amps, with most such systems carrying milliamp-level currents.

Household voltage and current levels—that is, the levels used by common household electrical devices—are much higher than those seen by low-power shielded cable connectors like those used with cable television, Internet or other similar signals. Industrial power levels used with the high-power VFD motors identified above are far higher than household ratings. The shielded connector disclosed and claims in the patent application is designed and rated for use in high-power industrial applications. These applications involve voltage and current ratings in excess of household levels and many orders of magnitude higher than the very low-power signals carried by convention shielded coaxial cable connectors.

For example, household currents within circuits are typically limited to 20 or 30 amps. Higher power circuits, such as those for ovens, large air conditioning systems, and the like, may have current ratings as high as 50 amps. Entire household electrical systems often are limited to 100 amps. The high-power industrial systems referred to in this application, on the other hand, are typically rated for 500 amps or more. These current ratings are much higher than any household rating, and many orders of magnitude higher than the milliamp current levels carried by typical coaxial cable shielded connectors.

The voltage levels are also much different. Typical household voltages are limited to 220 volts or less. Most household circuits are limited to 111 volts. The high-power industrial systems with which the current invention is used are typically rated for 400 volts or more.

In an oilfield VFD application, the cables can weigh hundreds of pounds. The core power conductors can be an inch thick or more and are very stiff. The shielding used in these high-power applications is much heavier and harder to work with than the thin shielding braid found on a home television cable. Cutting, crimping, and other typical tasks associated with making up electrical connectors all take on a very different nature when large, high-power cables are involved.

One particular challenge found in the high-power VFD application that is not present with low power cable television connectors is the difficulty in making up nearly identical connections repeatedly. Given the size, weight, and stiffness of the large power cables involved in high-power VFD applications, it is not practical to use a connector that requires precise and consistent positioning of all the connections between the connector and the supply cable. This difficulty is particularly true for the connection to the high-power cable shielding, which can be quite difficult to handle. It is, therefore, highly desirable for a high-power, shielded VFD connector to allow for some variance in the positioning of the connections involved, while still providing a reliable, fully shielded connector.

Because the supply cable used in high-power VFD applications is so heavy and stiff, it is almost impossible to make up a connection with such cable if a quick turn or change of direction is required. Consider, for example, a connection made in a physical space where the supply cable must turn 45° immediately after the point of connection. It may not be possible to bend the cable to create this sharp a turn. There is a need, therefore, for a connector that solves this problem by allowing for use of heavy, shielded power cables, while providing the ability to make sharp bends or turns.

Finally, it is desirable for this connector to have an internal insulator between the shielded shell of the connector and the internal power conductor. Such an insulator should allow for access to lug bolts while also providing the capability to fully isolate, electrically, the internal power conductor once the connection has been made up. The insulator should be reliable and easy to use.

The present invention may be used with single-pole cables and terminal connections or with multi-pole systems. For example, a shielded cable with a single core conductor may be used with the present invention, this being a single-pole application. Alternatively, the present invention may be used with a three-phase, shielded system, where the high-power cable has three core conductors (i.e., one for each of the three phases, with each carrying full current load). In the three-phase system, three connections are needed for the core connectors, but a single shielding connection may be sufficient if a single shielding layer is used around all of the core conductors. This is the most common multi-pole configuration. The present invention, however, may also be used if each core conductor is separately shielded, as will be explained in the detailed description below.

The present invention provides the high-power shielded connector needed for use with high-power VFD motors and power supplies. In a preferred embodiment, the connector includes a high-power, multi-pole electrical connector rated for currents in excess of 100 amps and voltages greater than 220 volts; an electrically conductive, generally cylindrical outer shell having an internal electrical contact region; an electrically insulating layer positioned between the single-pole connector and the electrically conductive outer shell; and, a generally cylindrical shielding trap configured to provide an electrical connection between a shielding material of a high-power, electrical cable and the internal electrical contact region of the electrically conductive outer shell.

The method of connecting a high-power, shielded electrical cable to the connector includes stripping the supply cable to expose its layers as follows: approximately 1.5 to 1.75 inches of a core conductor; approximately 0.75 to 1.25 inches of a core conductor insulation; and, approximately 0.25 to 0.75 inches of a shielding layer. A high-power, single-pole electrical connector is connected to the exposed portion of the core conductor. A shielding trap is connected to the exposed portion of the shielding layer, such that the core conductor insulation is positioned between the shielding trap and the high-power, single-pole electrical connector. An insulating barrier is positioned around at least a portion of each high-power line connection; and, an electrically conductive outer shell is positioned over the insulating barrier, the high-power, multi-pole electrical connector, and the shielding trap such that the shielding trap is in electrical contact with the outer shell and the outer shell is electrically isolated from the high-power, multi-pole electrical connector.

DETAILED DESCRIPTION OF CERTAIN PREFERRED EMBODIMENTS OF THE INVENTION

Figure 1:
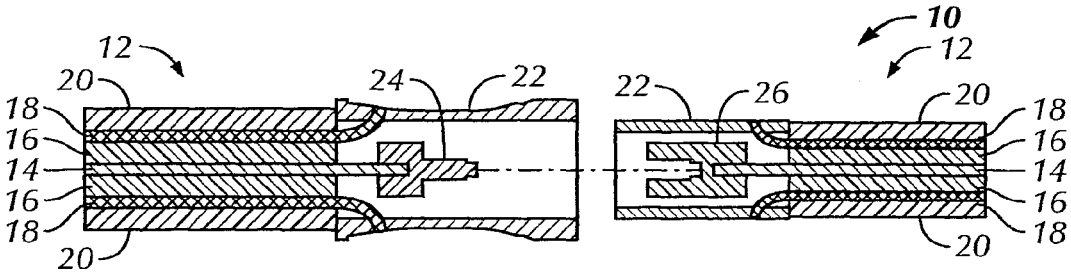
FIG. 1 is a conceptual cross-sectional drawing of a preferred embodiment of an inline connector in accordance with the present invention.

The present invention is best understood through reference to the accompanying drawings. FIG. 1 is a conceptual drawing of a high-power shielded connector 10. High-power shielded cables 12 are shown connected to male and female in-line versions of the connector 10.

Figure 2:
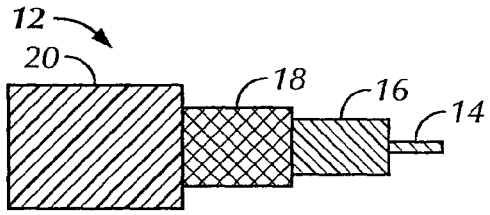
FIG. 2 is a side view of a power supply cable of the type often used with the present invention.

The parts of the cable 12 are shown in more detail in FIG. 2. A core conductor 14 makes up the center part of the cable 12. The core conductor 14 for high-power applications of the type for which the present invention is intended may be a single conductor or a twisted group of multiple conductors. The core conductor 14 should be capable of carrying up to 1,000 amps, or more. Such a conductor will be quite large, perhaps one inch in diameter or larger. A core conductor of this size and capacity is quite heavy and very stiff.

The next layer of the cable 12 is the core conductor insulation 16. This is a solid layer of electrically insulating material surrounding the core conductor 14. In the high-power applications, the insulator material must be chosen from a stable material that is not subject to breakdown at relatively high operating temperatures. With such high currents possible in the core conductor 14, considerable heat may be generated during use. The core conductor insulator 16 must be capable of withstanding high temperatures without breaking down.

The shielding 18 is the next layer of the cable 12. In high-power operations, the shielding is relatively heavy and stiff. Shielding may be braided or a solid layer, though braided shielding is believed to be more common. Either type works with the present invention. Some high-power shielded cables include a thin layer of Mylar or other similar material around the core conductor insulation 16. This type of configuration is not shown, and its use or nonuse is not material to the present invention. The shielding 18 is covered by the outer insulation 20. Another outer layer of highly durable material may be placed around the outer insulation 20, though the use of such material does not impact the performance of the present invention. Such materials, however, may be desirable to prevent excessive wear to the power cables in environments where such cables are subjected to considerable stress and wear.

When used with a preferred embodiment of the present invention, the core conductor 14 is stripped so that approximately 1⅝" of the conductor are bare. The core conductor insulation 16 is striped so that approximately 1" of it is exposed. About ½" of the shielding is exposed by the stripping process. This produces the "stair-step" cross-section shown in FIG. 2. The lengths of the different parts of the fully stripped cable are approximate, and variations of ⅛ to ¼ inch for any or all of the stated dimensions are not expected to alter the performance of the present invention.

Returning to FIG. 1, it can be seen that the outer insulation 20 buts up against the end of the connector 10. The shielding 18 extends into the interior of the connector 10 and is then electrically connected, or in electrical contact with, the outer shell 22 of the connector 10. This is shown conceptually in FIG. 1. The core conductor 14 coming into the connector 10 from the left side in FIG. 1 is connected to a male single pole connector 24, which is positioned inside an electrically conductive outer shell 22. The single pole connectors used with the present invention may be of a type disclosed in patent application Ser. No. 12/015,661, which is incorporated by reference into the present application. A connector of the type disclosed in the cited application may be connected to the end of the core conductor 14.

On the right side of FIG. 1, is a conceptual drawing of a female version of the connector 10. A female single pole conductor 26 is shown connected to the core conductor 14 of the power cable 12, and is positioned within an electrically conductive outer shell 22. The shielding 18 is connected to the outer shell 22, as was shown for the male version of the connector 10.

The conceptual drawing illustrates the key operational characteristics of the invention. Two distinct electrical paths are maintained through the connector, with the core conductor path being fully contained within the outer shielding path. Thus, the core conductor is fully surrounded by an electrical shield both in the cable 12 and in the connector 10. This is the key feature needed by a high-power, shielded connector. The connector 10 must provide a reliable, low-resistance electrical connection for high power lines that is fully shielded.

Given the size and stiffness of the high-power cables, it is difficult to make a shielded connector that is both functional (i.e., meets the functional needs described above) and user friendly. For example, if a shielded connector is designed so that the power cable connections must be made to precise tolerances, the connector will be of little use in the field.

The nature of the connection between the shielding 18 and the conductive outer shell 22 poses another challenge. The connector cannot be too large in diameter or it will be too unwieldy to be of practical use in the field. The power cables used in these high-power applications typically range from 1.5 to 2.5 inches in outside diameter. The connector 10, therefore, should be approximately 3-4 inches in diameter, at the most. If the connector 10 is much larger than that, its size will make it less practical.

Given these sizing constraints, and the stiffness of the cable, it is difficult, if not impossible, to use a fixed or permanent connection between the shielding 18 and the outer shell 22 of the connector 10. Once a single pole conductor is connected to the core conductor 14, the cable 12 is positioned within the outer shell 22. At this point, the outer shell 22 covers the entire length of the exposed shielding 18. To make a fixed or permanent connection between the shielding 18 and the outer shell 22 would require an operator to somehow work within the small space between the cable 12 and the outer shell 22. Given the size and stiffness of the cable 12, such an operation is simply not feasible.

Nor is it feasible to use a fixed internal contact within the outer shell 22. If this were done, the operator would have to strip the cable 12 to precise length requirements and the operator would still have to make up at least part of the connection between the shielding 18 and the outer shell 22 within the small space between the cable 12 and the shell 22.

The present invention solves these challenges by using a shielding trap 30, which is illustrated in FIGS. 3-6. The shielding trap 30, in a preferred embodiment, is made of two separate rings made of electrically conductive material. A single piece shield trap could be used, but is not shown. For example, recessed slots or grooves with screw-down clamps could be used to attach the shielding to a single piece shielding trap. The two-piece shielding trap 30 shown in the drawings is preferred, but a single-piece trap also would work with the present invention.

Figure 3:
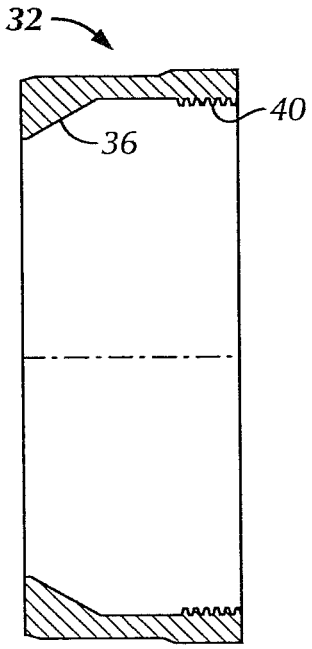
FIGS. 3 and 4 are side view, cross sections of two pieces of a shielding braid trap in accordance with the present invention.
Figure 4:
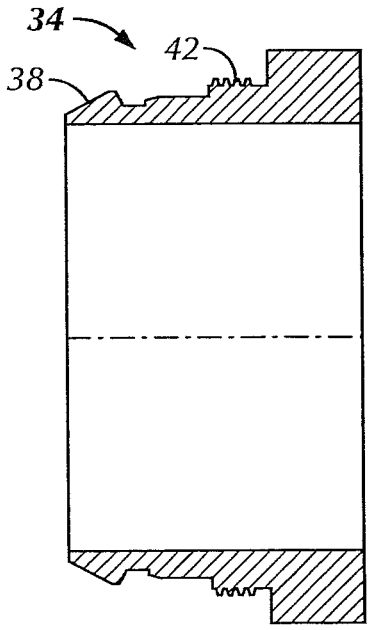
Figure 5:
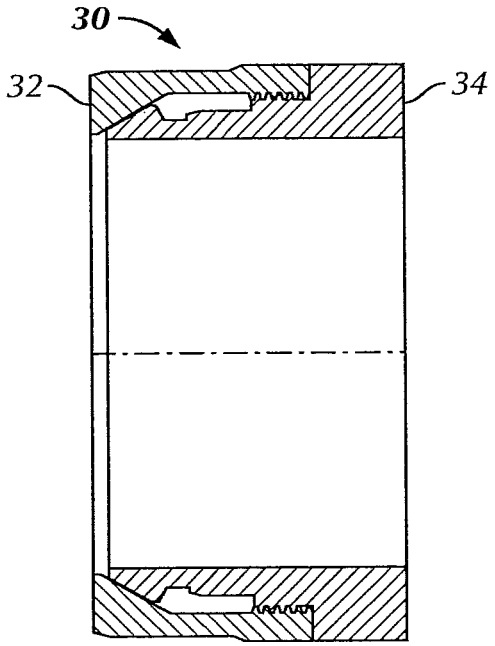
FIGS. 5 and 6 are side view, cross sections of a shielding trap in accordance with the present invention.

A first threaded ring 32 and a second threaded ring 34 are shown in FIGS. 3 and 4 respectively. The first threaded ring 32 has a first shielding contact surface 36 and a first set of threads 40. The second threaded ring 34 has a second shielding contact surface 38 and a second set of threads 42. These separate rings are threaded together to form the shielding trap 30, as shown in FIG. 5.

Figure 6:
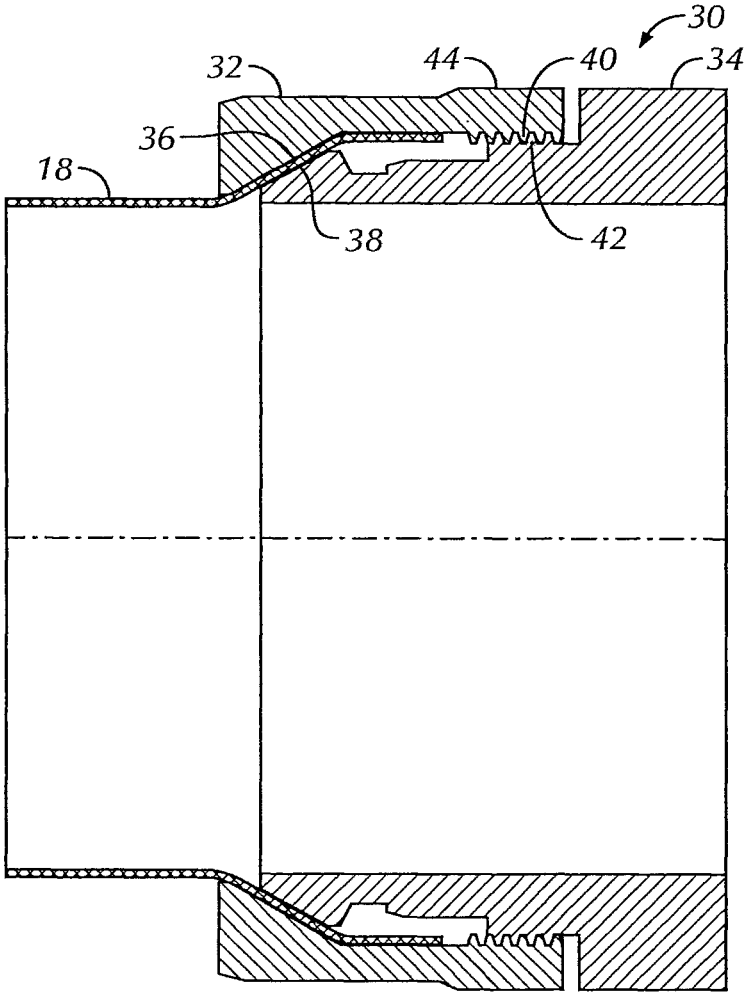

FIG. 6 shows how the shielding 18 is connected to the shielding trap 30. The shielding 18 is positioned between the first shielding contact surface 36 and the second shielding contact surface 38. The first threads 40 and second threads 42 are engaged and tightened. This action brings the two shielding contact surfaces into a compression fit against the shielding 18. This result provides a secure connection that will not pull out (i.e., is physically secure) and that provides good electrical conductivity.

A fully made-up shielding trap 30 is shown in FIG. 6. In actual use, the core conductor insulation 16 and the core conductor 14 would be concentrically within the shielding trap 30. That is, the inner two parts of the cable 12 would continue past the shield trap, extending farther into the connector 10. Enough of the core conductor insulation 16 should be exposed to ensure that this insulation layer extends beyond the entire length of the shielding trap 30. As shown in FIG. 6, this requirement means the core conductor insulation would extend past the second threaded ring 34. Outer contacts 44 are also shown. These contacts are better understood by reference to FIG. 7.

Figure 7:
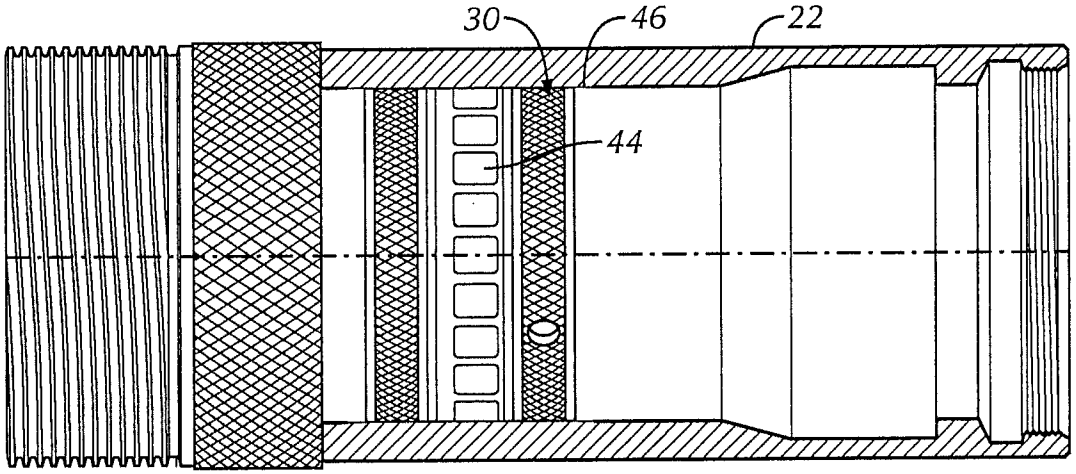
FIG. 7 is a cut-away view showing the outside of a shielding trap in accordance with the present invention.

In FIG. 7, a cut-away is shown of the portion of the connector 10 housing the shielding trap 30. The outer shell 22 is electrically conductive, but in practice may be coated with a material that greatly reduces the conductivity of its surfaces. Such a coating may be used for various reasons, including to reduce wear or corrosion. Corrosion resistance is a particular concern in offshore oilfield applications because of the salty environment.

In order to provide a good electrical connection between the shielding trap 30 and the outer shell 22, a contract region 46 is provided within the outer shell 22. This contact region 46 may be formed by machining away a very small layer of the shell 22, thus removing any coating material and exposing the more conductive material of the shell 22. The contact region 46 is sufficiently long to allow for some play in the positioning of the shielding trap 30. In a preferred embodiment, a contact region 46 of about ½ to ¾ inch is long enough to provide the needed play. A longer contact region 46 may be advantageous in some situations to provide ever greater tolerance for variations in the lengths of the stripped cable 12. This might be desirable when connectors are used in environments like the North Atlantic Sea or north of the Arctic Circle, where very low temperatures may make working with these types of materials even more difficult.

In FIG. 7, the shield trap 30 is shown with a series of outer contacts 44. These contacts may be a "finger" type of contact made of thin flaps of electrically conductive material that come into physical contact with the contract region 46 of the outer shell 22. By making such contact, an electrical path is established between the shielding 18 of the power cable 12 and the outer shell 22 of the connector 10. Because the shield trap 30 is connected to the cable 12 before the cable is positioned inside the outer shell 22, the connection is relatively easy to make. The contract region 46 is long enough so that the electrical connection is much less dependent upon the precise positioning of the shield trap 30 on the cable 12.

Figure 8:
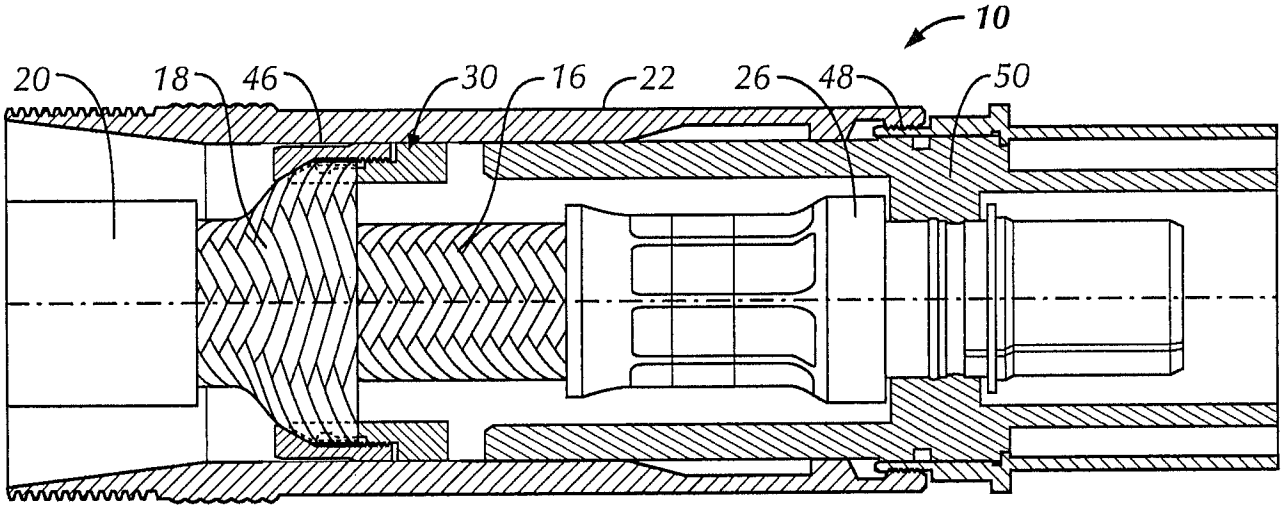
FIG. 8 is a cut-away view of a shielded connector in accordance with the present invention.

A cross-section of the connector 10 of the present invention is shown in FIG. 8. This figure shows a female version of an in-line connector in accordance with the present invention. The single pole female connector 26 is of the type disclosed in U.S. patent application Ser. No. 12/015,661, referenced above, though other types of single pole connectors may be used, as well. The core conductor 14 is crimped to the female single pole connector 26. The core conductor insulation 16 is shown between the female single pole conductor 26 and the shielding trap 30. As described above, the core conductor insulation 16 is exposed through stripping so that this insulation layer extends beyond the forward end of the shielding trap 30, where the forward end is in the direction of the female single pole connector 26 and away from the supply cable 12. The shielding trap 30 is connected to the shielding 18 as described above.

The method of assembling the connector can vary somewhat, but a preferred sequence follows. The cable 12 is stripped to leave the desired lengths of the various parts exposed. The shield trap 30 is then connected to the shielding 18. The female single pole connector 26 (as shown in FIG. 8; other types of single pole connectors also may be used) is then crimped to the core conductor 14. This assembly is then slid into the outer shell 22 of the connector 10.

In the embodiment shown in FIG. 8, the outer shell 22 of the connector 10 has two distinct parts. These parts may be joined through threads 48, which provide an electrically conductive path for the shielding. Alternatively, a conductive contact ring may be used to ensure a good electrical connection between different parts of the connector shell 22. FIG. 8 also shows the use of electrical insulation inside the connector 10, and between the single pole connector 26 and the outer shell 22. This insulation ensures the shielding path is electrically separate from the core conductor path.

In practice, a male version of the connector shown in FIG. 8 would be inserted into the illustrated female connector. The connection between the male and female connectors may be secured through use of additional threaded connections between the outer shells of the two connectors. For example, one of the two connectors may have an outer threaded ring that is configured to be threaded to matched threads on the other connector. This type of connection ensures both a good electrical connection for the shielding and a physically secure connection. The latter concern is very important in practice because of the very high power levels involved. An inadvertent disconnection during operation could be catastrophic.

Figure 9:
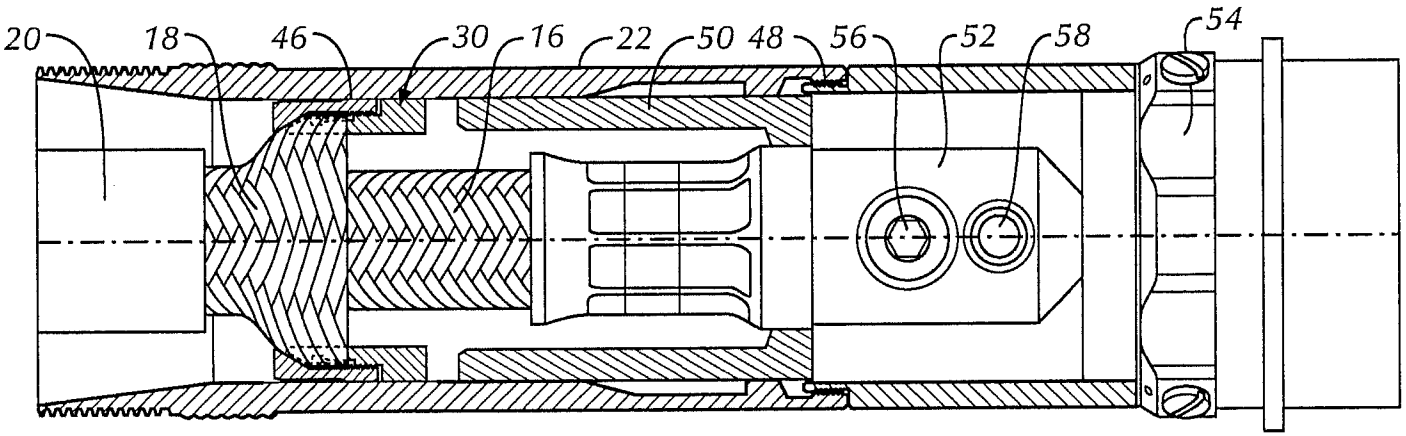
FIG. 9 is a cut-away view of an alternate embodiment of a shielded connector in accordance with the present invention.

FIG. 9 shows an alternative embodiment of the present invention with a lug-type single pole connector rather than a male/female type connector. A variable angle, single pole, lug connector 52 is shown inside the outer shell 22 of the connector. The shielding 18 is connected to the shielding trap 30 as described above, and is in electrical contact with the contact region 46 of the outer shell 22. The cable outer insulation 20 is shown at the cable end of the connector. Insulation 50 is positioned between the lug connector 52 and the outer shell 22. An optional cap 54 is also shown in FIG. 9. The cap 54 may be used to cover the end of the connector when it is not in use.

The lug connector 52 is secured to another connector or a contact using a first lug bolt 56 and a second lug bolt 58. An oversized, tapered hole is provided to accommodate the head of the lug bolt. To reduce the length of the lug connector 52, the lug bolt holes can be configured so that one lug bolt is started from each side of the connector. That configuration is shown in FIG. 9, where a larger hole is shown in connection with the first lug bolt 56, to indicate that the head of the first lug bolt 56 is started from the side of the connector shown in the drawing. The smaller hole shown with the second lug bolt 58 results from the fact that the second lug bolt 58 is started from the opposite side of the connector. This configuration allows for a shorter lug connector 52, and thus shortens the overall length of the connector.

When the lug bolt arrangement described above is used, it is necessary to access both sides of the lug connector to tighten or loosen both lug bolts. It is also necessary to provide insulation between the lug connector 52 and the outer shell 22. This poses a challenge, because if an access hole is provided in the insulator, then a gap in the insulation would exist at the access hole.

Figure 10:
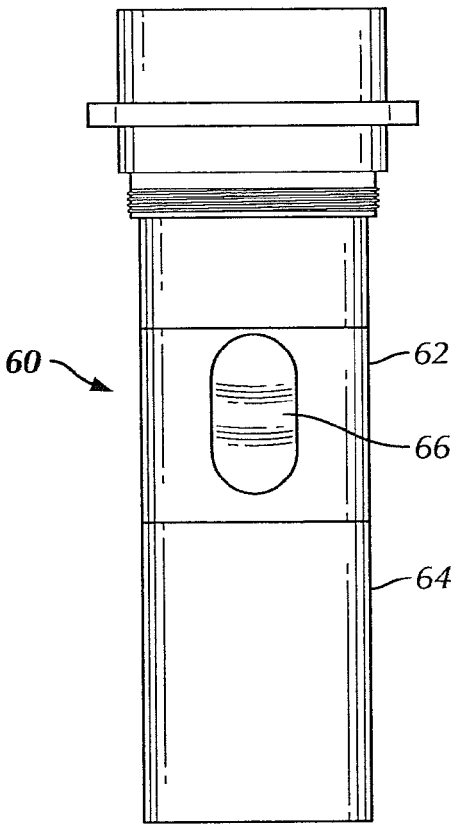
FIGS. 10 and 11 are side views of an insulator used with a single-pole lug connector in accordance with the present invention.
Figure 11:
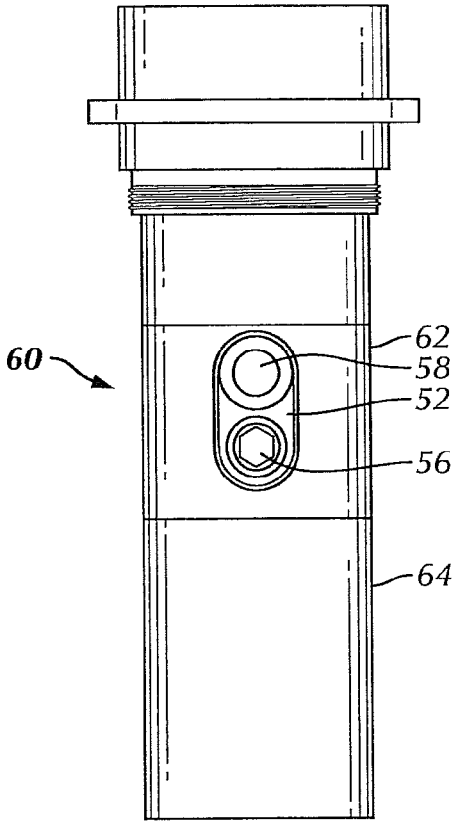

To solve this problem, the present invention utilizes a dual sleeve insulator 60, which is shown in FIGS. 10 and 11. The insulator 60 has a first cylindrical insulating shell 62 and a second cylindrical insulating shell 64. The second cylindrical insulating shell 64 extends along the full length of the insulator 60, with upper and lower sections shown in FIGS. 10 and 11. The middle portion of the second cylindrical insulating shell 64 has a reduced diameter, and the first cylindrical insulating shell 62 fits over the second shell 64 in this middle region, as shown in FIGS. 10 and 11. The two shells fit securely over the lug connector 52, but may be rotated together or separately around the lug connector 52.

Two oval access holes 66 are provided, one in each of the two cylindrical insulating shells. The two shells may be rotated relative to each other to align the access holes 66, as shown in FIG. 11, or to fully cover the lug connector, as shown in FIG. 10. This allows the shells to be used to provide access to the lug bolts when necessary, but also allows for a complete insulating barrier around the lug connector when access to the lug bolts is not required.

In operation, the insulator 60 is used as follows. The first cylindrical insulating shell 62 is rotated so that the oval access holes 66 are aligned with each other. Both insulating shells are then rotated together until the oval access holes 66 are positioned over one side of the lug bolts holes, as shown in FIG. 11. The first lug bolt 56 is then screwed into the lug bolt hole with the tapered, oversized opening. Once this lug bolt is tightened (partial tightening may be preferable at this stage), both cylindrical insulating shells are rotated together (i.e., to keep the oval access holes 66 in alignment) by 180° so that the oval access holes 66 are positioned over the opposite side of the lug connector 52. The second lug bolt 58 is then started in the second lug bolt hole. The cylindrical insulating shells may be rotated as necessary to tighten both of the lug bolts. Once the lug bolts are tight, the first cylindrical insulating shell 62 is rotated relative to the second cylindrical insulating shell 64 so that the insulator 60 provides a complete insulating barrier around the lug connector 52, as shown in FIG. 10. The outer shell 22 may then be positioned over the insulator 60 and the connection may be completed.

Figure 12:
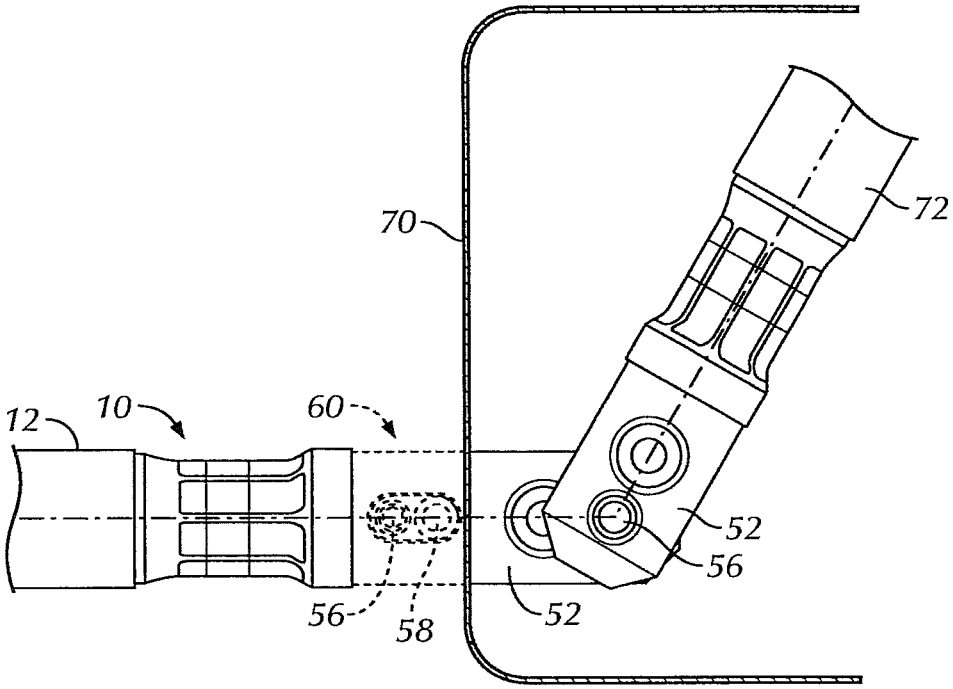
FIG. 12 is a conceptual, side-view drawing showing a lug insulator in accordance with the present invention and showing one lug connector at an approximately 45° angle.

The lug connector 52 also allows for angled connection, as shown in FIG. 12. A supply cable 12 is shown connected to a connector 10, which includes a lug connector 52, an insulator 60, and first and second lug bolts 56 and 58, respectively, all being of the same general configuration described above. These components are shown connected to a panel-mount lug connector, which is positioned on the casing of a VFD motor 70. The motor casing 70 provides shielding from noise within the motor, so that shielded cables and connectors are not needed within the casing.

It is possible, however, that a sharp bend or turn in the power line path may be needed inside the motor casing 70. This can be accomplished using the lug connector 52 and only a first lug bolt 56. The connector 52 can be positioned at almost any angle when connected in this manner, which provides desirable space saving within the casing of a motor or other component. Variable angle connections of this type are not possible when using the full connector 10, having the outer shell 22, as described above, but variable angle connections are feasible inside the casings of motors or other components. This is desirable because the need for an angled connection may be most common within motors or other components, rather than for in-line connectors.

The connector of the present invention allows for relatively easy and reliable installation in the field. The method of installing the connector 10 includes stripping the high-power electrical cable 12 to expose its inner layers, as shown in FIG. 2. In a preferred embodiment, the stripping results in the following lengths of the layers: approximately 1.625 (one and five-eighths) inches of core conductor is exposed; approximately one inch of the core conductor insulation is then exposed; and approximately 0.5 inch of the shielding layer is exposed. The first ring 32 of the shielding trap 30 is then slid over the cable 12 to the end of the exposed shielding 18. The shielding 18 is then lifted or pried away from the cable 12, so that the shielding 18 extends at an angle of about 45° from the longitudinal axis of the cable. The second ring 34 of the shielding trap 30 is then slid over the cable 12, and under the angled shielding 18. The first and second rings are then screwed together, creating a physically secure and electrically conductive connection between the shielding and the shielding trap.

A high-power, single-pole electrical connector is connected to the exposed part of the core conductor. This can be done before or after the shielding trap 30 is connected, but it may be simpler to connect the shielding trap first because of the added weight of the single-pole connector. The sequence is not critical, however, unless the single-pole connector has a larger outside diameter than the inside diameter of the first and second threaded rings of the shielding trap 30. If that is true, the shielding trap rings must be installed before the single-pole connector is connected.

When the shielding trap 30 and single-pole connector have been securely connected to the shielding 18 and the core conductor 14, respectively, an insulating barrier may be positioned over part or all of the single-pole connector. The outer shell 22 may then be positioned over the other parts of the connector.

The description presented above is directed to a single-pole embodiment of the present invention, but the invention may be used with multi-pole cables and systems, as well. For example, three-phase power systems are common in many industrial settings. A three-phase, VFD system may use a three-phase supply cable, with three core conductors and possibly other conductors, all surrounded by shielding and an outer insulator. The present invention is compatible with these types of multi-pole or multi-conductor systems, as well.

For example, if a three-phase system uses a power cable having three core conductors (i.e., one for each phase of the power supply) and a shield layer positioned radially outward from the core conductors, the present invention may be used to ensure a continuous connection of both the core conductors and the shielding across the connector. The benefits of the present invention described above would apply equally in this embodiment.

In a typical three-phase, high-power supply cable, there are three main core conductors, one for each phase. A ground cable is also supplied, and in some instances, a separate ground may be supplied for each primary phase conductor. Other power conductors may also be included, with all of the power conductors being routed inside of an outer shielding layer and an outer insulating layer. Each of the internal conductors typically has an insulating layer around the conductor, so that each is fully insulated within the power cable.

To use the present invention with this type of multi-pole cable (e.g., with a typical three-phase power cable), the internal power connections are made up in the same manner described above. A lug-type connector may be used, as described above, or a different core conductor connection may be used. One such connection is needed for each power conductor. For example, when a typical three-phase cable is used, the present invention would employ three separate core conductor connections, and each such connection may be like the connection described above in relation to FIGS. 8-11. The difference between the prior embodiments and a multi-pole embodiment of the present invention is that a single shield trap may be sufficient to provide a continuous shield for a three-phase (or other multi-pole) connector. If the power cable has a single, outer shield layer, as is typical in the industry, then a single shield trap may be used to provide a shielding connection using the present invention.

The present invention will require a larger overall connector for a multi-pole embodiment because more than one primary core conductor will be used, and therefore, more than one core conductor connection will be needed. But each core conductor may be connected in the same manner described above. The insulation around each core conductor connection may be different where multiple core conductors are used. For example, the present invention may require use of separate insulating layers around each of the core power conductor connections. As a result of the need for separate connections and insulating layers for each core conductor, a multi-pole (e.g., three-phase) embodiment of the present invention will require a larger overall connector. The present invention will require a larger overall diameter (i.e., for a given rated power level), and for that reason, a larger shield trap. This requires only a change in sizing, and does not otherwise alter the nature of the present invention.

In a preferred embodiment of the invention, a multi-pole connector is used to make the electrical connections between the primary core conductors. The multi-pole connector may be of any standard configuration, including a multi-pin type connector where each core conductor is connected to a separate pin or receptacle. One cable end would be connected to the pin side of this type of connector, while the other cable end would be connected to the receptacle side of the connector. The pin side would be inserted into the receptacle side to make up the connection, thus completing the electrical path for all the core conductors. The core conductors in this instance may include three (or more) primary power conductors (e.g., as in a three-phase supply cable), one or more ground conductors, and possibly other power conductors as well.

By using a multi-pole connector to make up the connections for all the core conductors, a single connector is used to accomplish this task. The present invention adds an insulation layer around the multi-pole connector, a shield trap, and an outer conductive shell to complete the apparatus. The insulation layer covers the multi-pole connector and keeps it electrically isolated from the shielding and from the electrical shielding path of the present invention. The electrical shielding path is through the shield trap and the outer conductive shell, as described in detail above. This is a key characteristic of the present invention: the two-part shield trap may be used with either a single-pole internal connector or with a multi-pole internal connector. The only variation required of the shield trap is to size the trap appropriately to match the physical size of the internal connector being used. The shield trap provides the important benefit of providing a continuous shielded line through an in-line connection or at a terminal connection. The shield trap of the present invention provides this benefit while allowing for field installation using standard tools. This benefit is a result, in part, of the installation tolerances for the placement of the shield trap.

Alternative internal connectors may be used with multiple conductor cables, too. For example, separate single-pole connectors may be used, with each such connector being fully insulated from every other connector. The shield trap of the present invention could be positioned around the group of single-pole connectors. An insulation layer would be needed between the shield trap or the outer conductive shell and the group of internal single-pole connectors if this configuration is used. The insulation around each connector may be sufficient, or a separate insulating layer may be desired to surround the group of single-pole connectors. The shield trap and outer conductive shell would be used in the same manner described above. If this configuration is used, the full connection may be quite large. For this reason, this configuration may be less desirable, but it will work and may be a needed configuration in certain situations. The present invention works even with this arrangement because of the flexibility provided by the shield trap and outer conductive shell.

The invention also may be used with multi-pole or multiple conductor systems having separately shielded conductors. For example, a high-power cable may carry two core conductors, with each conductor being separately shielded. The present invention may be used in such a setting by using a single-pole embodiment for each of the two separately shielded power conductors. Alternatively, the present invention could use a single shield trap, splicing together the shielding from each of the separate power conductor cables. Determining what embodiment will be most suitable for a particular application will depend upon judgments made based on the particular facts of each application. The important point here is that the present invention provides the flexibility to provide an embodiment that will work in almost any application. The drawings and description provided above are meant to provide reasonable descriptions of some of the uses and variations of the present invention. Such descriptions are not meant to limit the scope of the invention in any way.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A shielded electrical connector, comprising: a multi-pole electrical connector;

a. an electrically conductive, generally cylindrical outer shell having an internal electrical contact region;

b. an electrically insulating layer positioned between the multi-pole connector and the electrically conductive outer shell; and, c. a generally cylindrical shielding trap configured to provide an electrical connection between a shielding material of a high-power, electrical cable and the internal electrical contact region of the electrically conductive outer shell.

2. The connector of claim 1, wherein the internal electrical contact region is between approximately ¼ and ¾ of one inch in length.

3. The connector of claim 1, wherein the shielding trap further comprises a. a first cylindrical ring having a first shielding contact; and, b. a second cylindrical ring having a second shielding contact, such that the shielding may be positioned between the first and second shielding contacts and secured in such position by the first and second cylindrical rings.

4. The connector of claim 3, further comprising outer contacts.

5. The connector of claim 3, wherein the first and second cylindrical rings are threaded rings such that the rings may be screwed together to secure the shielding to the shielding trap.

6. The connector of claim 2, wherein the internal electrical contact region is formed by removing an electrically nonconductive coating from an inner surface of the outer shell.

7. The connector of claim 1, wherein the multi-pole connector is rated for current levels of at least 750 amps.

8. The connector of claim 1, wherein the multi-pole connector is a lug-type connector.

9. The connector of claim 8, wherein the lug-type connector may be connected to another contact at variable angles.

10. The connector of claim 8, wherein the electrically insulating layer further comprises a first concentric cylindrical insulating shell and a second concentric cylindrical insulating shell, the first concentric cylindrical insulating shell being positioned over and radially outside of at least a portion of the second concentric cylindrical insulating shell, such that the two shells may be rotated about the lug-type connector together or such that one shell rotates relative to the other shell.

11. The connector of claim 10, wherein the first concentric cylindrical insulating shell has a first oval access hole and the second concentric cylindrical insulating shell has a second oval access hole, and wherein the two access holes may be aligned to provide access to the lug-type connector and may be realigned to provide a complete electrically insulating barrier around the lug-type connector.

12. A shielding trap for use with a high-power, shielded, multiple conductor electrical cable, comprising:

a. a first cylindrical threaded ring having a first shielding contact;

b. a second cylindrical threaded ring having a second shielding contact, such that a shielding material of one of the high-power, shielded conductors of the electrical cable may be positioned between the first and second shielding contacts and secured in such position by screwing together the first and second threaded rings; and, c. an outer electrical contact positioned on the outside surface of the shielding trap, wherein the shielding trap is rated for use in an electrical connector rated for currents greater than 100 amps and voltages greater than 220 volts.

13. A shielded, multi-pole electrical connector for use with high-power variable frequency drive (VFD) motors in industrial applications, comprising:

a. a high-power, multi-pole electrical connector rated for current of greater than 100 amps and voltages greater than 220 volts, the connector configured for connection to core conductors of a high-power, shielded, VFD power supply cable; and, b. an electrically conductive outer shell configured for electrical contact with a shielding layer of the high-power, shielded, VFD power supply cable, and wherein the outer shell is electrically isolated from the high-power, multi-pole connector.

14. A method of connecting a shielded, multi-pole electrical connector to a high-power, shielded electrical supply cable comprising:

a. stripping the supply cable to expose its layers as follows:

i. approximately 1.5 to 1.75 inches of each core conductor;

ii. approximately 0.75 to 1.25 inches of each core conductor insulation; and, iii. approximately 0.25 to 0.75 inches of a shielding layer, wherein said shielding layer is located radially outward of each of the core conductors and the core conductor insulation;

b. connecting a high-power, multi-pole electrical connector to the exposed portion of the core conductors;

c. connecting a shielding trap to the exposed portion of the shielding layer, such that the core conductor insulations are positioned between the shielding trap and the high-power, multi-pole electrical connector;

d. positioning an insulating barrier around at least a portion of the high-power, multi-pole electrical connector; and, e. positioning an electrically conductive outer shell over the insulating barrier, the high-power, multi-pole electrical connector, and the shielding trap such that the shielding trap is in electrical contact with the outer shell and the outer shell is electrically isolated from the high-power, multi-pole electrical connector.

15. The method of claim 14, wherein step e. further comprises positioning the shield trap so that it is in electrical contact with an inner contact region of the outer shell.

16. A method of connecting a shielding trap to a shielding layer of a high-power, shielded electrical cable comprising;

a. stripping the cable to expose approximately 0.2 to 0.6 inches of the shielding layer;

b. positioning a first cylindrical ring of the shielding trap over the cable such that the first cylindrical ring is positioned on the unstripped cable side of the exposed shielding layer;

c. lifting the shielding layer away from the longitudinal axis of the cable so that the shielding layer is positioned at an angle of approximately 30° to 60° from the longitudinal axis of the cable;

d. positioning a second cylindrical ring of the shielding trap on the side of the exposed and lifted shielding layer nearer the stripped end of the cable, such that the shielding layer is positioned between the first and second cylindrical rings; and, e. securing the first and second cylindrical rings together such that the exposed and lifted shielding layer is secured between the two rings, providing a secure physical and electrical connection between the shielding layer and the shielding trap.

17. The method of claim 16, wherein the first and second cylindrical rings are screwed together in step e.

* * * * *